US009972889B2

(12) United States Patent
Hong et al.

(10) Patent No.: US 9,972,889 B2
(45) Date of Patent: May 15, 2018

(54) MULTIBAND ANTENNA AND ELECTRONIC APPARATUS HAVING THE SAME

(71) Applicant: SAMSUNG ELECTRONICS CO., LTD., Suwon-si (KR)

(72) Inventors: Won-bin Hong, Seoul (KR); Young-ju Lee, Seoul (KR); Alexander Goudelev, Suwon-si (KR); Kwang-hyun Baek, Anseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 261 days.

(21) Appl. No.: 13/933,719

(22) Filed: Jul. 2, 2013

(65) Prior Publication Data

US 2014/0125526 A1 May 8, 2014

(30) Foreign Application Priority Data

Nov. 8, 2012 (KR) ..... 10-2012-0126121

(51) Int. Cl.

| | |
|---|---|
| ***H01Q 1/38*** | (2006.01) |
| ***H01Q 1/24*** | (2006.01) |
| ***H01Q 9/42*** | (2006.01) |
| ***H01Q 5/371*** | (2015.01) |
| ***H01Q 5/392*** | (2015.01) |

(52) U.S. Cl.

CPC ..... *H01Q 1/243* (2013.01); *H01Q 5/371* (2015.01); *H01Q 5/392* (2015.01); *H01Q 9/42* (2013.01)

(58) Field of Classification Search

USPC ..... 343/702, 700 MS, 722

See application file for complete search history.

(56) References Cited

U.S. PATENT DOCUMENTS

| | | | | |
|---|---|---|---|---|
| 6,639,558 | B2 * | 10/2003 | Kellerman et al. | 343/700 MS |
| 7,301,499 | B2 * | 11/2007 | Shin et al. | 343/700 MS |
| 7,825,863 | B2 * | 11/2010 | Martiskainen | H01Q 1/243 343/700 MS |

OTHER PUBLICATIONS

Communication dated Sep. 29, 2017 by the Korean Intellectual Property Office in counterpart Korean Patent Application No. 10-2012-0126121.

* cited by examiner

*Primary Examiner* — Jessica Han
*Assistant Examiner* — Hai Tran
(74) *Attorney, Agent, or Firm* — Sughrue Mion, PLLC

(57) ABSTRACT

A multiband antenna apparatus and an electronic apparatus having the multiband antenna apparatus are provided. The multiband antenna apparatus includes: a low frequency antenna which transmits and receives at least one low frequency band signal; and a high frequency antenna which transmits and receives at least one high frequency band signal, wherein the low frequency antenna includes a single wing part which emits an electric wave.

19 Claims, 6 Drawing Sheets

MULTIBAND ANTENNA AND ELECTRONIC APPARATUS HAVING THE SAME

CROSS-REFERENCE TO RELATED APPLICATION(S)

This application claims priority under 35 U.S.C. § 119 from Korean Patent Application No. 10-2012-0126121, filed on Nov. 8, 2012, in the Korean Intellectual Property Office, the disclosure of which is incorporated herein by reference, in its entirety.

BACKGROUND

1. Field

The present inventive concept generally relates to an electronic apparatus having a multiband antenna. More particularly, the preventive concept relates to a multiband antenna apparatus which transmits and receives low and high frequency band signals, and an electronic apparatus having the same.

2. Description of the Related Art

With the continuing development of communication technology, there has appeared a high-speed wireless network technology which transmits and receives high-capacity data by using a high frequency band in a wirelessly communicable electronic field.

An example of a high-speed wireless network standard includes WiGig. The WiGig is an international standard whereby a Wi-Fi communication is performed at a speed between 1 Gbps and 7 Gbps 10 times or more, faster than current Wi-Fi in a band of 60 GHz internally commonly distributed as a non-licensed band. A wireless network standard of a high frequency band, such as WiGig, or the like, has been gradually commercialized. Thus, an antenna supporting such a high frequency band is required in an electronic apparatus.

If an electronic apparatus includes an antenna which supports a high frequency band according to a tendency to slimming of the electronic apparatus, the antenna may be integrated with an antenna using a low frequency band to be included in the electronic apparatus rather than may be installed separately from the antenna using the low frequency band.

Therefore, there is required a method of implementing slimming of an electronic apparatus for a wireless communication and supporting low and high frequency bands in an antenna installed in the electronic apparatus.

SUMMARY

Exemplary embodiments address at least the above problems and/or disadvantages and other disadvantages not described above. Also, the exemplary embodiments are not required to overcome the disadvantages described above, and an exemplary embodiment may not overcome any of the problems described above.

The exemplary embodiments provide a multiband antenna apparatus which transmits and receives low and high frequency band signals and implements slimming of the apparatus, and an electronic apparatus having the same.

According to an aspect of the exemplary embodiments, there is provided a multiband antenna apparatus which is installed in an electronic apparatus for wireless communication. The multiband antenna apparatus may include: a low frequency antenna which transmits and receives at least one low frequency band signal; and a high frequency antenna which transmits and receives at least one high frequency band signal, wherein the low frequency antenna comprises a single wing part which emits an electric wave.

The multiband antenna apparatus may further include: at least one power supply which supplies power to the multiband antenna apparatus.

The wing part may operate as a ground of the high frequency antenna.

The multiband antenna apparatus may further include: a printed circuit board (PCB) substrate which is disposed on the wing part and which supports the high frequency antenna.

The high frequency antenna may be an array antenna.

The high frequency band signal may be a frequency band signal of 60 GHz.

The low frequency antenna may transmit and receive two low frequency band signals.

The two low frequency band signals may be frequency band signals of 2.4 GHz and 5 GHz.

The low frequency antenna may further include: a ground plate which is disposed to be separated from the wing part by a predetermined distance.

The power supply as implemented may be connected to the wing part and the ground plate.

The wing part may include: a first emitter which is connected to the power supply and which emits an electric wave to transmit and receive one of the two low frequency band signals; and a second emitter which extends from a side of the first emitter and emits an electric wave to transmit and receive the other one of the two low frequency band signals.

The high frequency antenna may be disposed on the first emitter.

The wing part may include: a first ground part which is disposed on the high frequency antenna; and a second ground part which is separated from the first ground part by a predetermined distance to form a slot between the first and second ground parts.

The power supply as implemented may be connected to the first and second ground parts.

The wing part may include: a first ground part which is disposed on the high frequency antenna; a second ground part which is separated from the first ground part by a predetermined distance to form a slot between the first and second ground parts; and a third ground part which is separated by a predetermined distance from the first ground part in order to form a second slot between the first and third ground parts.

The power supply may be connected to the first, second, and third ground parts.

The low frequency antenna may further include: a subsidiary wing part which is beside the wing part to be separated by a predetermined distance from the wing part and amplifies an electric wave emission of the wing part.

The power supply may include: a first power supply which is connected to the wing part and the ground plate; and a second power supply which is connected to the subsidiary wing part and the ground plate.

The high frequency antenna may be disposed on the wing part.

According to another aspect of the exemplary embodiments, there is provided an electronic apparatus comprising the multiband antenna apparatus.

As described above, according to various exemplary embodiments of the present general inventive concept, an antenna apparatus may transmit and receive low and high frequency band signals and contribute to implementation of a slimming of the electronic apparatus. An electronic apparatus may include the antenna apparatus.

BRIEF DESCRIPTION OF THE DRAWINGS

The above and/or other aspects will be more apparent by describing certain exemplary embodiments with reference to the accompanying drawings, in which.

DETAILED DESCRIPTION OF THE EXEMPLARY EMBODIMENTS

Figure 1:
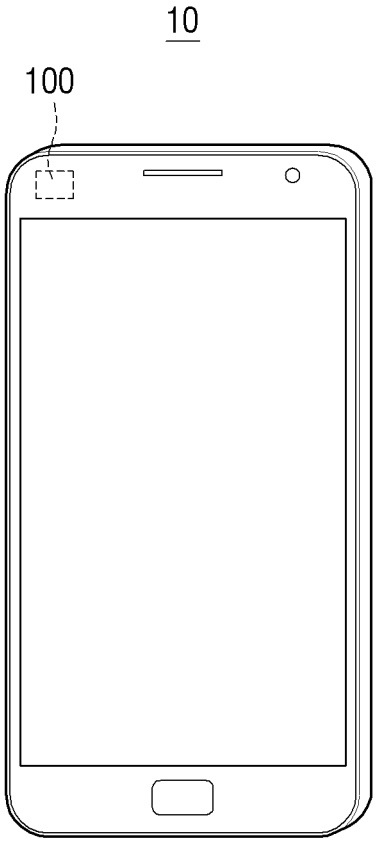
FIG. 1 is a perspective view which illustrates an electronic apparatus according to an exemplary embodiment.

Exemplary embodiments are described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

FIG. 1 is a perspective view which illustrates an electronic apparatus 10 according to an exemplary embodiment.

The electronic apparatus 10 may be implemented by various types of wirelessly communicable apparatuses. For example, the electronic apparatus 10 may be various types of apparatuses, such as a display apparatus such as a TV, a camera, a portable computer, a smart phone, etc. In an exemplary embodiment, the electronic apparatus 10 will be described as a smart phone.

Referring to FIG. 1, the electronic apparatus 10 includes a multiband antenna apparatus 100.

The multiband antenna apparatus 100 is embedded in the electronic apparatus 10. The multiband antenna apparatus 100 transmits and receives radio frequency (RF) signals in at least three types of different frequency bands. In an exemplary embodiment, the multiband antenna apparatus 100 will be limitedly described as transmitting and receiving two low frequency band signals and one high frequency band signal. The two low frequency band signals respectively have respective frequency bands of 2.4 GHz and 5 GHz, and the high frequency band signal has a frequency band of 60 GHz. However, the inventive concept is no hereto. Thus, frequencies in other bands may be used.

The multiband antenna apparatus 100 may reduce the bulk size than an antenna apparatus may otherwise occupy in the electronic apparatus 100, and may reduce the bulk size more than an antenna apparatus which includes a low frequency antenna and a high frequency antenna which are separately installed in an electronic apparatus. Therefore, the multiband antenna apparatus 100, according to an exemplary embodiment may contribute to slimming of the electronic apparatus 10. The multiband antenna apparatus 100 will now be described in detail with reference to FIG. 2.

Figure 2:
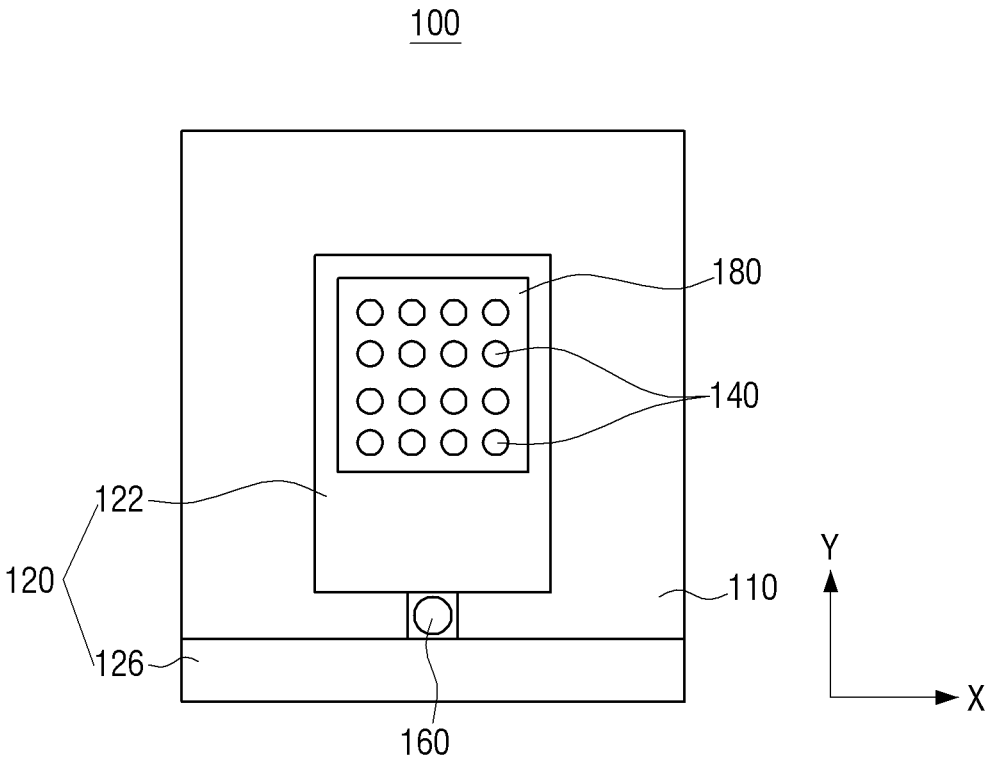
FIG. 2 is a schematic plan view which illustrates a multiband antenna apparatus installed in the electronic apparatus of FIG. 1, according to an exemplary embodiment.

FIG. 2 is a schematic plan view which illustrates the multiband antenna apparatus 100 installed in the electronic apparatus 10 of FIG. 1, according to an exemplary embodiment.

Referring to FIG. 2, the multiband antenna apparatus 100 includes a first printed circuit board (PCB) substrate 110, a low frequency antenna 120, a high frequency antenna 140, a power supply 160, and a second PCB substrate 180.

The first PCB substrate 110 is installed at the electronic apparatus 10 of FIG. 1 and is formed of a nonmetallic material. The low frequency antenna 120 is installed on the first PCB substrate 110. The first PCB substrate 110 is installed in a position of the electronic apparatus 10 of FIG. 1 in which an emission of an antenna is smooth.

The low frequency antenna 120 includes a wing part 122 and a ground plate 126.

The wing part 122 is implemented through a pattern design as a rectangular plate shape on the first PCB substrate 110. The wing part 122 is printed in a monopole shape on the first PCB substrate 110. Therefore, the wing part 122 has a smaller size than if the wing part 122 were manufactured in a dipole shape. Thus, the multiband antenna apparatus 100 is manufactured in a small size. As a result, a size of the multiband antenna apparatus 100 which is contained in the electronic apparatus 10 of FIG. 1 is small, and thus contributes to slimming of the electronic apparatus 10 of FIG. 1.

The wing part 122 emits an electric wave outside the electronic apparatus 10 of FIG. 1 to transmit and receive a low frequency band signal. The wing part 122 emits the electric wave to selectively transmit and receive two low frequency band signals. In other words, the low frequency antenna 120 according to an exemplary embodiment selectively transmits and receives the low frequency band signals of 2.4 GHz and 5 GHz, and the wing part 122 emits the electric wave when transmitting and receiving each frequency band.

The wing part 122 operates as a ground of the high frequency antenna 140. In other words, the ground of the high frequency antenna 140 is the wing part 122 of the low frequency antenna 120. However, the inventive concept is not limited thereto, and the ground of the high frequency antenna 140 may be formed of another side of an emission side of an antenna, according to the design.

The ground plate 126 keeps a distance from the wing part 122 in order to be installed on the first PCB substrate 110. The ground plate 126 is formed of metal to operate as a ground of the low frequency antenna 120

The high frequency antenna 140 is installed on an upper surface of the wing part 122. The high frequency antenna 140 is an array antenna in which a plurality of emission elements are arrayed. However, the inventive concept is not limited thereto. Thus, the high frequency antenna 140 may be an antenna which includes a single emission element.

The power supply 160 is connected to the wing part 122 and the ground plate 126 and is connected to a power supplier (not shown) which supplies power to the multiband antenna apparatus 100. The power supply 160 may be a micro-coaxial connector or other connectors having appropriate structures, according to the design.

The second PCB substrate 180 is disposed between the wing part 122 and the high frequency antenna 140 to support the high frequency antenna 140 which is the array antenna. The second PCB substrate 180 may be formed of a nonmetallic material similar to the first PCB substrate 110.

As described above, the low frequency antenna 120 and the high frequency antenna 140 are integrated into the multiband antenna apparatus 100 according to the present an exemplary embodiment. Therefore, the multiband antenna apparatus 100 which transmits and receives a low frequency band signal and a high frequency band signal may be made small.

Figure 3:
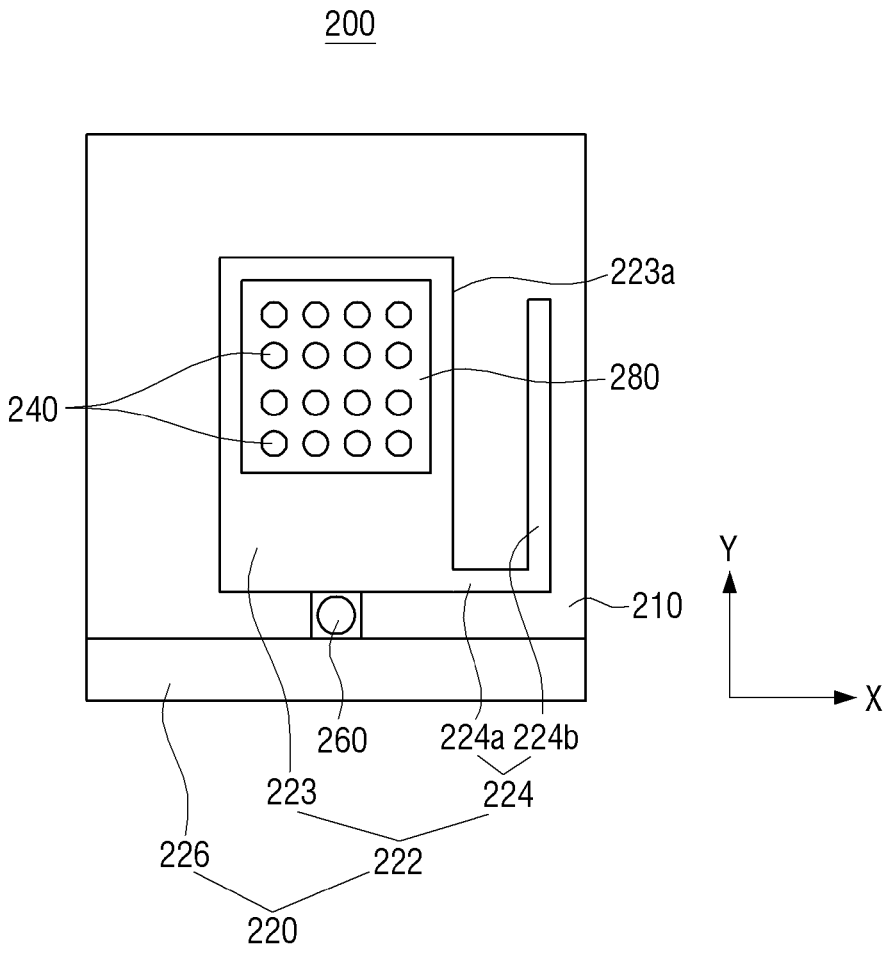
FIG. 3 is a schematic plan view which illustrates a multiband antenna apparatus according to another exemplary embodiment.

FIG. 3 is a schematic plan view which illustrates a multiband antenna apparatus 200 according to an exemplary embodiment.

Referring to FIG. 3, the multiband antenna apparatus 200 includes a first PCB substrate 210, a low frequency antenna 220, a high frequency antenna 240, a power supply 260, and a second PCB substrate 280.

The first PCB substrate 210, the high frequency antenna 240, the power supply 260, and the second PCB substrate 280 are respectively the same as the first PCB substrate 110, the high frequency 140, the power supply 160, and the second PCB substrate 180, and thus their repeated descriptions will be omitted.

The low frequency antenna 220 includes a wing part 222 and a ground plate 226.

The wing part 220 includes first and second emitters 223 and 224.

The first emitter 223 is implemented as through a pattern design as a rectangular plate shape on the first PCB substrate 210. The first emitter 223 is patterned in a monopole shape to be printed on the first PCB substrate 210. The high frequency antenna 240 is installed on the first emitter 223. In particular, the second PCB substrate 280 is installed on the first emitter 223, and the high frequency antenna 240 is installed on the second PCB substrate 280.

The first emitter 223 emits an electric wave which transmits and receives one frequency band signal. The first emitter 223 emits the electric wave which transmits and receives one of the low frequency band signals of 2.4 GHz, as and 5 GHz described above in the previous exemplary embodiment.

The second emitter 224 includes first and second extending parts 224*a* and 224*b*.

The first extending part 224*a* extends a predetermined distance from an edge of the first emitter 223 in a first direction (an X direction). The second extending part 224*b* extends a predetermined distance from the first extending part 224*a* in a second direction (a Y direction) and faces the edge 223*a* of the first emitter 223. In other words, the second emitter 224 is formed in an L shape but is not limited thereto. Therefore, the second emitter 224 may extend from the first emitter 223 in another shape according to the design.

The second emitter 224 emits an electric wave which is transmits and receives a low frequency band signal which different from the low frequency band signal of the first emitter 223. If the low frequency antenna 220 transmits and receives two low frequency band signals of 2.4 GHz and 5 GHz, and the first emitter 223 is used to transmit and receive a the low frequency band signal of 2.4 GHz, the second emitter 224 emits the electric wave which is transmits and receives the low frequency band signal of 5 GHz. If the first emitter 223 is used to transmit and receive the low frequency band signal of 5 GHz, the second emitter 224 is used to transmit and receive a frequency band signal of 2.4 GHz. In other words, the first and second emitters 223 and 224 emit electric waves which transmit and receive different frequency band signals.

As described, the multiband antenna apparatus 200 according to an exemplary embodiment may independently control electric waves which transmit and receive two frequency band signals through the first and second emitters 223 and 224, differently than from the previous exemplary embodiment.

Figure 4:
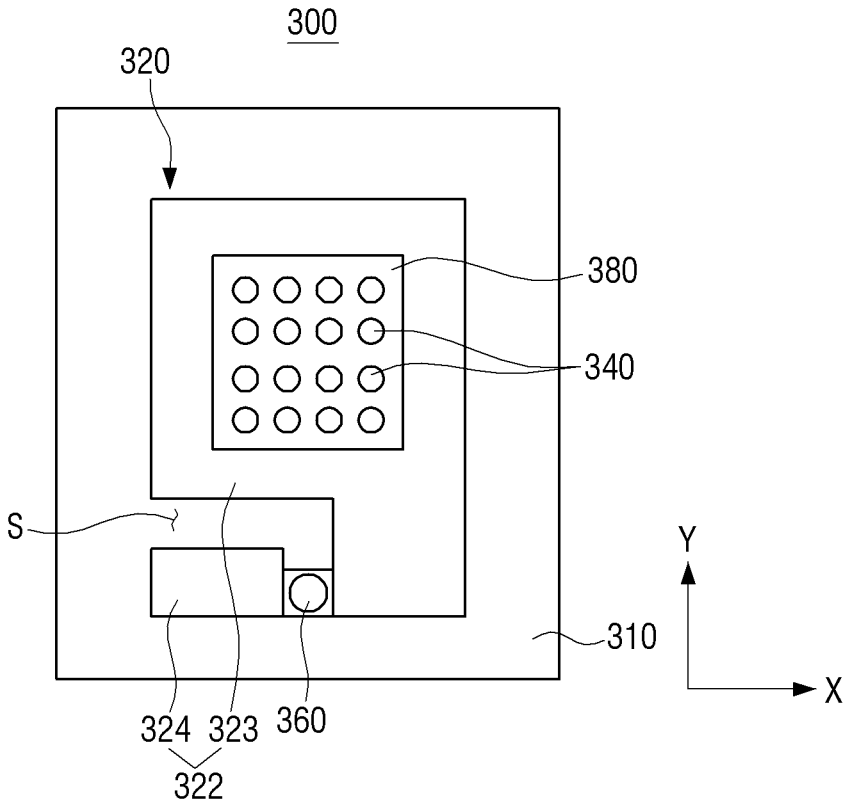
FIG. 4 is a schematic plan view which illustrates a multiband antenna apparatus according to another exemplary embodiment.

The ground plate 226 is the same as the ground plate 126 of the previous exemplary embodiment, and thus its repeated description will be omitted FIG. 4 is a schematic plan view which illustrates a multiband antenna apparatus 300 according to another exemplary embodiment.

Referring to FIG. 4, the multiband antenna apparatus 300 according to an exemplary embodiment includes a first PCB substrate 310, a low frequency antenna 320, a high frequency antenna 340, a power supply 360, and a second PCB substrate 380.

The first PCB substrate 310, the high frequency antenna 340, and the second PCB substrate 380 are the same as the first PCB substrate 110, the high frequency antenna 140, and the second PCB substrate 180 of the previous exemplary embodiment, and thus their repeated descriptions will be omitted.

The low frequency antenna 320 includes a wing part 322 which includes first and second ground parts 323 and 324

The high frequency antenna 340 is disposed on the first ground part 323. In particular, the high frequency antenna 340 is disposed on the second PCB substrate 380, and the second PCB substrate 380 is disposed on the first ground part 323. The second ground part 324 faces a side of the first ground part 323 at a distance from the first ground part 323 in order to form a slot S in the shape of a rectangular plate shape between the first ground part 323 and the second ground part 324. However, the inventive concept is not limited thereto, and thus the first and second ground parts 323 and 324 may be formed in other shapes according to the design.

The first and second ground parts 323 and 324 operate as grounds of the low frequency antenna 320 and the high frequency antenna 340.

The power supply 360 is connected to the first and second ground parts 323 and 324 and supplies power to the multiband antenna apparatus 300. In response to the multiband antenna apparatus 300 being supplied with the power through the power supply 360, the multiband antenna apparatus 300 emits an electric wave which is to transmit and receive a low frequency band signal through the slot S due to a voltage difference between the first and second ground parts 323 and 324. In other words, in the multiband antenna apparatus 300, according to an exemplary embodiment, the low frequency antenna 320 operates as a slot antenna.

As described above, the low frequency antenna 320 may be the slot antenna, and the slot antenna may emit an electric wave which selectively transmits and receives low frequency band signals of 2.4 GHz and 5 GHz, as in a previous exemplary embodiment described with reference to FIG. 2.

Figure 5:
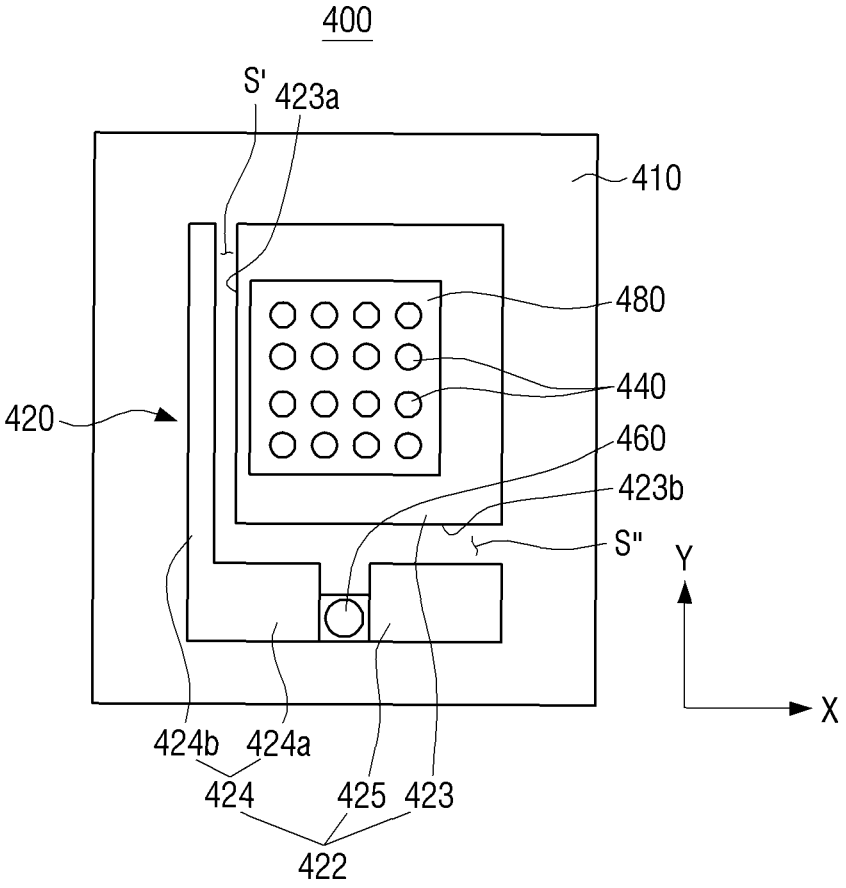
FIG. 5 is a schematic plan view which illustrates a multiband antenna apparatus according to another exemplary embodiment.

FIG. 5 is a schematic plan view which illustrates a multiband antenna apparatus 400 according to another exemplary embodiment.

Referring to FIG. 5, the multiband antenna apparatus 400 includes a first PCB substrate 410, a low frequency antenna 420, a high frequency antenna 440, a power supply 460, and a second PCB substrate 380.

The first PCB substrate 410, the high frequency antenna 440, and the second PCB substrate 480 are the same as the first PCB substrate 110, the high frequency antenna 140, and the second PCB antenna 180 of the previous exemplary embodiment described with reference to FIG. 2, and thus their repeated descriptions will be omitted.

The low frequency antenna 420 includes a wing part 422 which includes first, second, and third ground parts 423, 424, and 425.

The first ground part 423 has a rectangular plate shape on which the high frequency antenna 440 is disposed. As in the previous exemplary embodiment described with reference to FIG. 4, the high frequency antenna 440 is disposed on the second PCB substrate 480, and the second PCB substrate 480 is disposed on the first ground part 423.

The second ground part 424 includes a horizontal part 424*a* and a vertical part 424*b*. The horizontal part 424*a* faces a side 423*b* of the first ground part 423 at a predetermined distance from the side 423*b*. The vertical part 424*b* extends from the horizontal part 424*b* in a second direction (a Y direction) and faces an other side 423*a* of the first ground part 423 at a distance from the other side 423*a*. Therefore, the first and second ground parts 423 and 424 form a first slot S' having an L shape.

The third ground part 425 is located a predetermined distance from the second ground part 424 in a first direction (an X direction) and faces the side 423*b* of the first ground part 423 at a predetermined distance from the side 423*b*. Therefore, the first and second ground parts 423 and 425 form a second slot S." However, the inventive concept is not limited thereto, and thus, the first, second and third ground parts 423, 424, and 425 may be formed in other shapes, according to the design.

The first, second, and third ground parts 423, 424, and 425 operate as grounds of the low frequency antenna 420 and the high frequency antenna 440.

The power supply 460 is connected to the first, second, and third ground parts 423, 424, and 425, disposed between the second and third ground parts 424 and 425, and supplies power to the multiband antenna apparatus 400. In response to the multiband antenna apparatus 400 being supplied with the power through the power supply 460, the multiband antenna apparatus 400 emits an electric wave which transmits and receives different frequency band signals through the first and second slots S' and S." In other words, the first and second slots S' and S" may emit an electric wave which transmits and receives different frequency band signals similar to the first and second emitters 223 and 224 of the previous exemplary embodiment, described with reference to FIG. 3.

As described above, the multiband antenna apparatus 400 according to an exemplary embodiment may independently control an electric wave which is to transmit and receive two frequency band signals through the first and second slots S' and S," even in a slot antenna structure.

Figure 6:
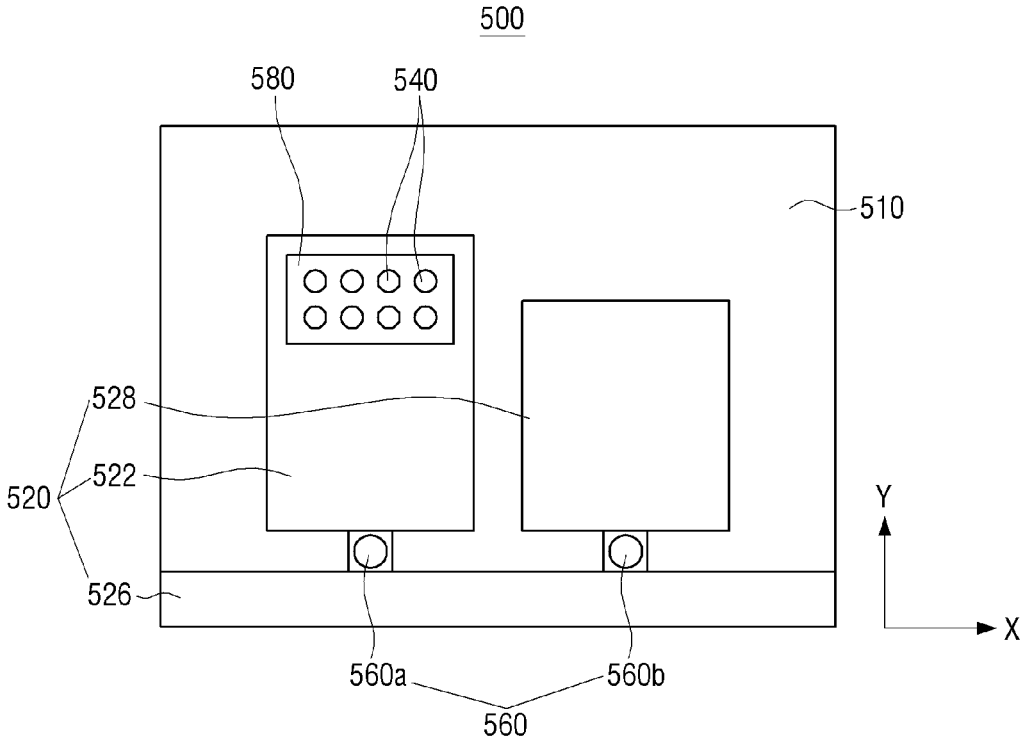
FIG. 6 is a schematic plan view which illustrates a multiband antenna apparatus according to another exemplary embodiment.

FIG. 6 is a schematic plan view which illustrates a multiband antenna apparatus 500 according to an exemplary embodiment.

Referring to FIG. 6, the multiband antenna apparatus 500 according to an exemplary embodiment includes a first PCB substrate 510, a low frequency antenna 520, a high frequency antenna 540, a power supply 560, and a second PCB substrate 580.

The first PCB substrate 510, the high frequency antenna 540, and the second PCB substrate 580 are the same as the first PCB substrate 110, the high frequency antenna 140, and the second PCB substrate 180 of the previous exemplary embodiment described with reference to FIG. 2, and thus their repeated descriptions will be omitted.

The low frequency antenna 520 includes a wing part 522, a ground plate 526, and a subsidiary wing part 528.

The wing part 522 and the ground plate 526 are the same as the wing part 122 and the ground plate 126 of the previous exemplary embodiment described with reference to FIG. 2, and thus their repeated descriptions will be omitted.

The subsidiary wing part 528 has a square plate shape, is installed on the first PCB substrate 510, and is separated by a predetermined distance from a side of the wing part 522 (in an X direction). The subsidiary wing part 528 emits an electric wave along with the wing part 528 when the low frequency antenna 520 emits an electric wave. Therefore, the low frequency antenna 520 may amplify the electric wave emission to improve the efficiency of the electric wave emission. In other words, in the multiband antenna apparatus 500 according to an exemplary embodiment, the low frequency antenna 520 may be a multi-input multi-output (MIMO) antenna.

The power supply 560 includes first and second power supply 560*a* and 560*b*.

The first power supply 560*a* is connected to the wing part 522 and the ground plate 526, and the second power supply 560*b* is connected to the wing part 528 and the ground plate 526. The first and second power supplies 560*a* and 560*b* are respectively connected to a power supply part (not shown) to supply power to the wing part 522 and the subsidiary wing part 528 of the low frequency antenna 520. The first and second power supplies 560*a* and 560*b* may be respectively micro-coaxial connectors or other types of connectors having appropriate structures according to the design.

The foregoing exemplary embodiments and advantages are merely exemplary in nature and are not to be construed as limiting. The present teaching can be readily applied to other types of apparatuses by those of ordinary skill in the art. Also, the description of the exemplary embodiments is intended to be illustrative, and not to limit the scope of the claims, and many alternatives, modifications, and variations will be apparent to those skilled in the art.

What is claimed is:

1. A multiband antenna apparatus which is installed in an electronic apparatus for wireless communication, the multiband antenna apparatus comprising:

a first antenna which transmits and receives a first frequency band signal;

a second antenna which transmits and receives a second frequency band signal; and at least one power supply which supplies power to the multiband antenna apparatus, wherein the first antenna comprises a wing part which emits an electric wave and a ground plate which is separated from the wing part by a predetermined distance, wherein the wing part and the ground plate are disposed on a first printed circuit board (PCB) and the second antenna is disposed on the wing part, and wherein the power supply is connected to the wing part and the ground plate.

2. The multiband antenna apparatus of claim 1, wherein the wing part operates as a ground of the second antenna.

3. The multiband antenna apparatus of claim 1, further comprising:

a second PCB substrate which is disposed on the wing part and supports the second antenna, wherein the second antenna is disposed on the second PCB substrate.

4. The multiband antenna apparatus of claim 3, wherein the second antenna is an array antenna.

5. The multiband antenna apparatus of claim 1, wherein the first frequency band signal is at least one low frequency band signal, and the second frequency band signal is at least one high frequency band signal.

6. The multiband antenna apparatus of claim 5, wherein the first antenna transmits and receives two low frequency band signals.

7. The multiband antenna apparatus of claim 6, wherein the two low frequency band signals are frequency band signals of 2.4 GHz and 5 GHz respectively.

8. The multiband antenna apparatus of claim 6, wherein the wing part comprises:

a first emitter emits an electric wave which transmits and receives one of the two low frequency band signals; and a second emitter emits an electric wave which transmits and receives the other one of the two low frequency band signals.

9. The multiband antenna apparatus of claim 8, wherein the second antenna is disposed on the first emitter.

10. The multiband antenna apparatus of claim 1, wherein the second frequency band signal is a millimeter wave frequency band signal.

11. The multiband antenna apparatus of claim 10, wherein the second frequency band signal is in a frequency band of 60 GHz.

12. The multiband antenna apparatus of claim 1, wherein the wing part comprises:

a first ground part on which the second antenna is disposed.

13. The multiband antenna apparatus of claim 1, wherein the first antenna further comprises:

a subsidiary wing part which is disposed beside the wing part by a predetermined distance.

14. The multiband antenna apparatus of claim 13, wherein the power supply comprises:

a first power supply which is connected to the wing part and the ground plate; and a second power supply which is connected to the subsidiary wing part and the ground plate.

15. An electronic apparatus comprising the multiband antenna apparatus of claim 1.

16. A multiband antenna apparatus which is installed in an electronic apparatus for wireless communication, the multiband antenna apparatus comprising:

a first antenna which transmits and receives a first frequency band signal;

a second antenna which transmits and receives a second frequency band signal; and at least one power supply which supplies power to the multiband antenna apparatus, wherein the first antenna comprises a wing part which emits an electric wave and a ground plate which is separated from the wing part by a predetermined distance, wherein the wing part and the ground plate are disposed on a first printed circuit board (PCB) and the second antenna is disposed on the wing part, and wherein the wing part comprises:

a first ground part on which the second antenna is disposed; and a second ground part which keeps a distance from the first ground part in order to form a slot between the first and second ground parts.

17. The multiband antenna apparatus of claim 16, wherein the power supply is connected to the first and second ground parts.

18. A multiband antenna apparatus which is installed in an electronic apparatus for wireless communication, the multiband antenna apparatus comprising:

a first antenna which transmits and receives a first frequency band signal;

a second antenna which transmits and receives a second frequency band signal; and at least one power supply which supplies power to the multiband antenna apparatus, wherein the first antenna comprises a wing part which emits an electric wave and a ground plate which is separated from the wing part by a predetermined distance, wherein the wing part and the ground plate are disposed on a first printed circuit board (PCB) and the second antenna is disposed on the wing part, and wherein the wing part comprises:

a first ground part on which the second antenna is disposed;

a second ground part which is separated by a predetermined distance from the first ground part in order to form a slot between the first and second ground parts; and a third ground part which is separated by from the first ground part by a predetermined distance from the first ground part to form a second slot between the first and third ground parts.

19. The multiband antenna apparatus of claim 18, wherein the power supply is connected to the first, second, and third ground parts.

* * * * *